US005190493A

United States Patent [19]

Li

[11] Patent Number: 5,190,493

[45] Date of Patent: Mar. 2, 1993

[54] FABRIC ROOF FOR SCALE MODEL VEHICLE AND METHOD OF ASSEMBLY

[75] Inventor: William Li, Hong Kong, Hong Kong

[73] Assignee: Franklin Mint Company, Franklin Center, Pa.

[21] Appl. No.: 816,995

[22] Filed: Jan. 3, 1992

[51] Int. Cl.[5] ..... A63H 17/26

[52] U.S. Cl. ..... 446/470; 446/88

[58] Field of Search ..... 446/470, 471, 87, 88, 446/93; 296/102, 104; 434/81

[56] References Cited

U.S. PATENT DOCUMENTS

| | | | |
|---|---|---|---|
| 1,353,900 | 9/1920 | Flatman | 446/471 X |
| 1,581,334 | 2/1924 | Appel . | |
| 1,709,367 | 8/1926 | Olguin | 296/102 |
| 3,553,887 | 1/1971 | Linstead | 446/471 |

FOREIGN PATENT DOCUMENTS

| | | | |
|---|---|---|---|
| 1068597 | 11/1959 | Fed. Rep. of Germany | 446/470 |
| 1040888 | 9/1966 | United Kingdom | 446/470 |

*Primary Examiner*—Mickey Yu

*Attorney, Agent, or Firm*—Seidel, Gonda, Lavorgna & Monaco

[57] ABSTRACT

A fabric covered roof for model vehicles. The roof is constructed by providing an upper frame having ribs formed on the upper surface thereof. A fabric cover is stretched over the ribs, covering the entire frame. The edges of the fabric cover are folded under the frame and secured to pegs on the bottom surface of the frame by washers. A lower plate, conforming to the contour of the bottom surface of the upper frame, having bores arranged in a matching pattern with the pegs is fitted within the frame and covering the edges of the fabric cover. The bottom surface of the lower plate having texture to simulate the visual texture of the fabric cover. Support posts are mounted in spaces between the lower plate and the upper frame at locations inline with the ribs to simulate completed bows for supporting the roof on the vehicle. A rear window insert is also press-fitted into matching openings in the back panels of the upper frame and lower plate.

10 Claims, 4 Drawing Sheets

FIG. 5
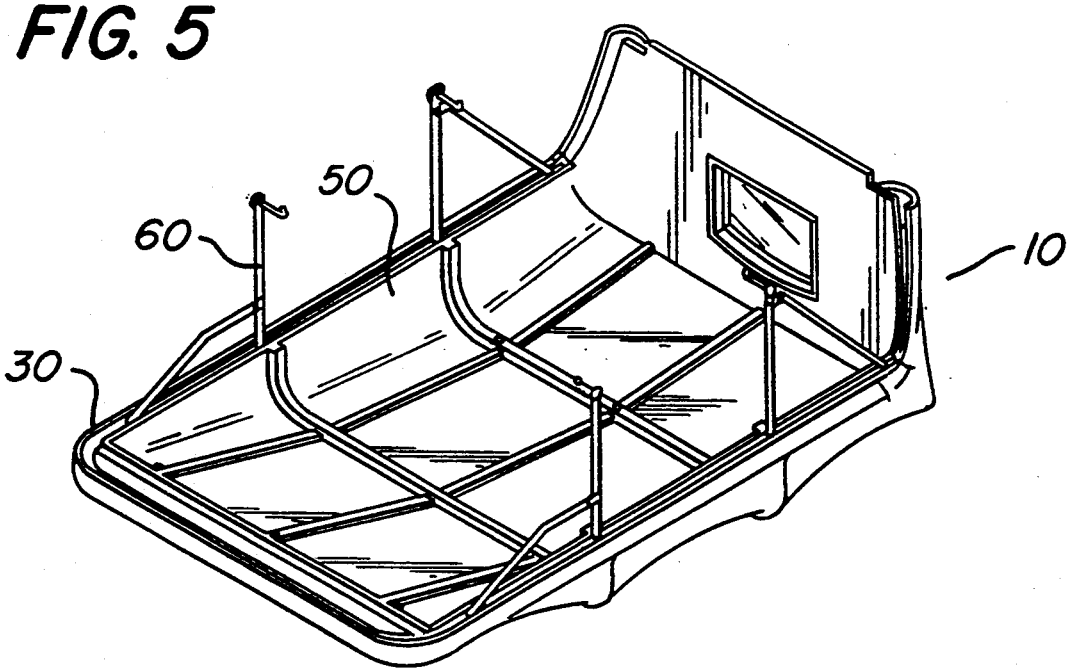
FIG. 6
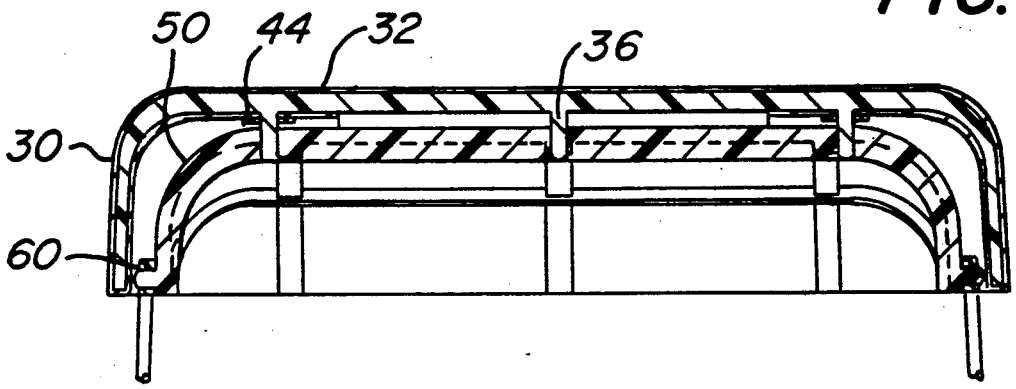
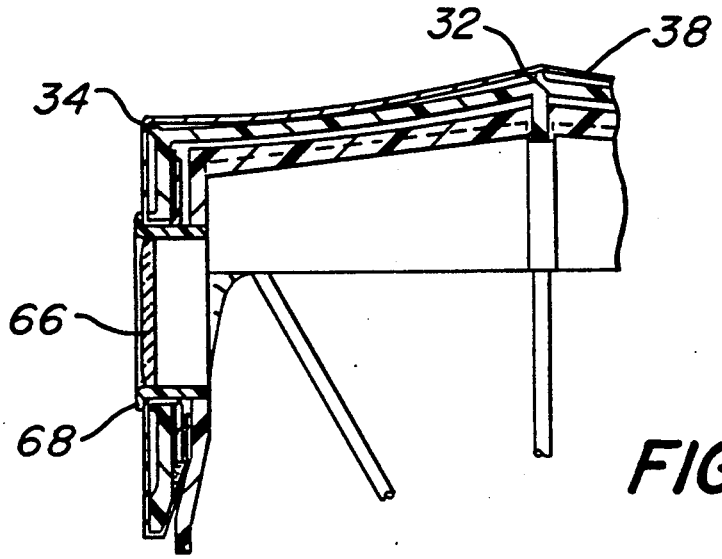
FIG. 7

FABRIC ROOF FOR SCALE MODEL VEHICLE AND METHOD OF ASSEMBLY

TECHNICAL FIELD

This invention is related to the general field of reduced-scale models of automobiles and similar vehicles. It is related to the specific field of making fabric roofs for such models which closely replicate the appearance and feel of the full-sized fabric roofs for such vehicles.

BACKGROUND ART

Many classic and luxury automobiles have had folding roofs of waterproofed fabric, attached to a frame of hinged or jointed rods which form "bows" to stretch the fabric into the shape of a roof when the rods are opened. At some time long past, these roofs have become popularly described as "convertible" because they can be collapsed and folded for open air driving.

Automotive enthusiasts and model makers frequently commemorate popular or distinctive vehicles by reduced scale models. The most significant aspect of creating such models in fine collector quality is the need to obtain a realistic duplication of the full-sized appearance and feel within the cost and complexity restraints of the reduced scale. Mere proportionate scaling of each detailed component would be impractical, if not impossible; yet to attain collector quality the miniaturized replica must create an illusion of being essentially identical to the original.

One particularly difficult modeling problem is to create a realistic duplication of the full-sized, fabric-covered, convertible roof of classic automobiles. For an appreciation of the complexity of the authentic full-sized convertible tops of the early automotive era (1920's) , one may consider the roofs disclosed in U.S. Pat. Nos. 1,415,377 (McGregor), 1,581,332 (Appel), and 1,709,367 (Olguin).

When creating a scaled roof which duplicates the appearance and feel of the originals, it is generally necessary to use a fabric having the same texture as the original. However, it is impractical in the reduced scale to stitch the reinforcing webs and seams or the hems and pockets used to attach the fabric to the bows. Likewise, it is impractical to proportionately scale snap fasteners and other small elements from the original. On extreme miniaturizations, it might be an acceptable substitute to use a solid molded roof with a fabric cover glued over it, but at 1:24 or larger scale the fabric would lack the resilient "give" between the bows and the stretched, "tucked-under", appearance of the original.

Consequently, an object of this invention is to provide a scaled fabric roof which duplicates the appearance and feel of the original. A further objective is to avoid sewing the fabric onto the bows and frame or stitching reinforcing webs and seems into the fabric. Another objective is that such roof be provide by structure and method of assembly which is practical within the cost and complexity restraints of the reduced scale.

The manner in which such objects are achieved by the present invention will be apparent upon reading the detailed description which follows, with reference to the drawings for illustrations of a particular embodiment. By way of overview, and to assist cursory searchers who do not wish to read the entire disclosure, the following section is provided as a brief summary disclosure of the invention in perfunctory and informal terms. However, persons seeking to understand the full scope of the invention should be aware that such understanding can only come from thorough reading of the claims found at the end of this document.

SUMMARY DISCLOSURE OF THE INVENTION

A fabric covered roof for model vehicles visually and tactilely simulates a vehicle roof of the type in which a fabric cover is attached to bows. The roof comprises a top frame which is spanned by upwardly extending transverse ribs shaped to simulate the top portion of the bows and to support the fabric with space between the ribs and frame to allow a resilient movement. A pattern of pegs depends from the frame's bottom face such that a fabric cover can be stretched over top of the ribs, folded around a side of the frame and clamped to a peg by a toothed washer. Then a bottom plate is fit inside the frame, the plate generally matching the contour of the frame, and having a matching pattern of bores arranged to receive the pegs to hold the frame and plate together. The bottom face of the plate may have raised belts shaped to simulate the bows, and a textured surface between the belts which simulates the visual appearance of the fabric cover. To add structural strength and mask the tips of the pegs, the bores are located in the raised belts. Support posts can be connected between the plate and the frame beneath each transverse rib to simulate the lower portion of the bows.

BRIEF DESCRIPTION OF THE DRAWINGS

For the purpose of illustrating the invention, the drawings show a form which is presently preferred, herein a roof for a scaled model of the venerated Model-T by Ford Motor Company. It will be understood, however, that this invention is not limited to the precise arrangements and instrumentalities shown.

FIG. 5 is an unexploded view of the roof as in FIG. 4.

FIG. 6 is a section view along the plane and in the direction indicated by the arrows 6—6 of FIG. 2.

FIG. 7 is a section view along the arrows 7—7 of FIG. 2.

BEST MODE FOR CARRYING OUT THE INVENTION

Figure 1:
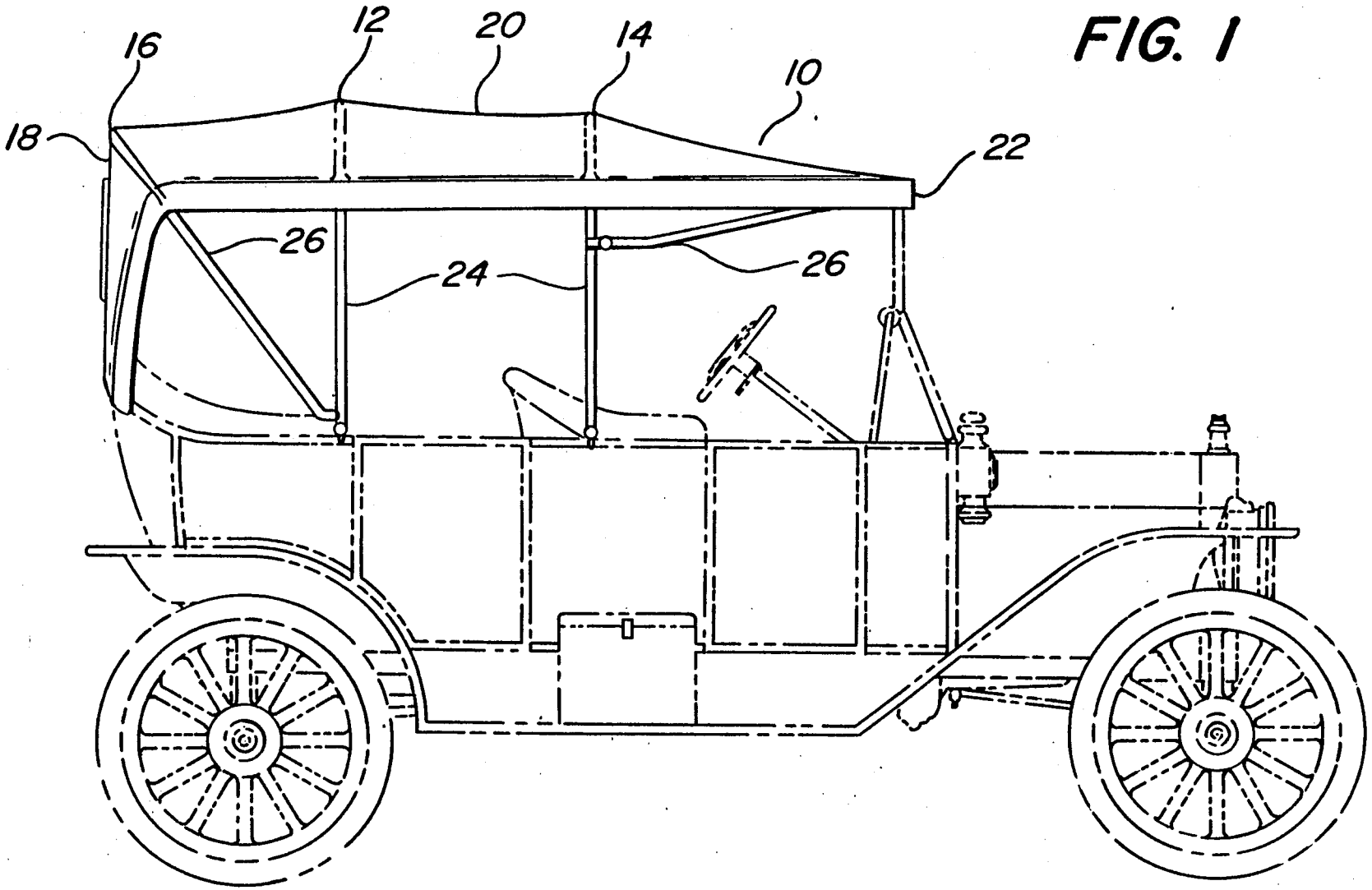
FIG. 1 is a side view of a scaled replica Model-T Ford automobile.
Figure 2:
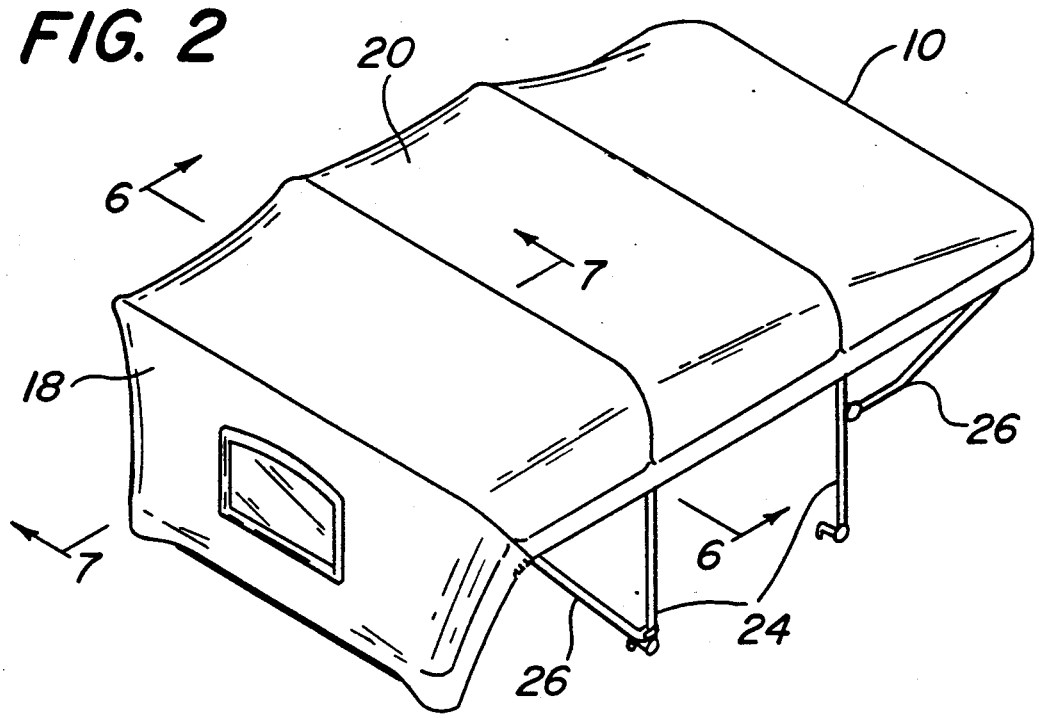
FIG. 2 is a top rear oblique view of the roof of the automobile of FIG. 1.

As shown in FIG. 1, the fabric roof (10) depicted in the drawings is a reduced scale replica of a fabric canopy roof, with a center window in its back curtain, which was produced on the Model-T Ford. As can be seen from the depicted replica, the fabric was supported over two vertical top bows (12,14), a diagonal bow (16) defining the rear edge which divides the vertical back curtain (18) from the top curtain (20), and a horizontal front bow (22) which locked onto the windshield posts. The bows themselves are end members of hinged or jointed rods (24,26) attached to the side panels of the chassis or to each other in such manner that the entire frame can be collapsed along the rear passenger bench with the fabric folded between the bows.

To create a scaled roof in 1:16 scale which duplicates the appearance and feel of the original Model-T canopy roof, the roof is made of nylon fabric having the same texture as the original, resulting in a top curtain approximately 5-¼ inches long and 3-⅜ inches wide, and a back curtain approximately 1-½ inches high. As will be immediately appreciated, it would be highly impractical to sew the reinforcing webs and stay pockets which appear on the original onto fabric of such small dimensions, or to sew the hems and pockets into which the bows are inserted to attach the original cover to the bows.

To replicate the feel of resilient "give" of the fabric between the bows, and the stretched "tucked-under" appearance of the fabric from the original, it is necessary to have the fabric supported and stretched over bows in some manner, but the small surface area of the bows and the need to attach the fabric under tension to create the stretch effect makes it impractical to glue the fabric over the bow framework.

Figure 3:
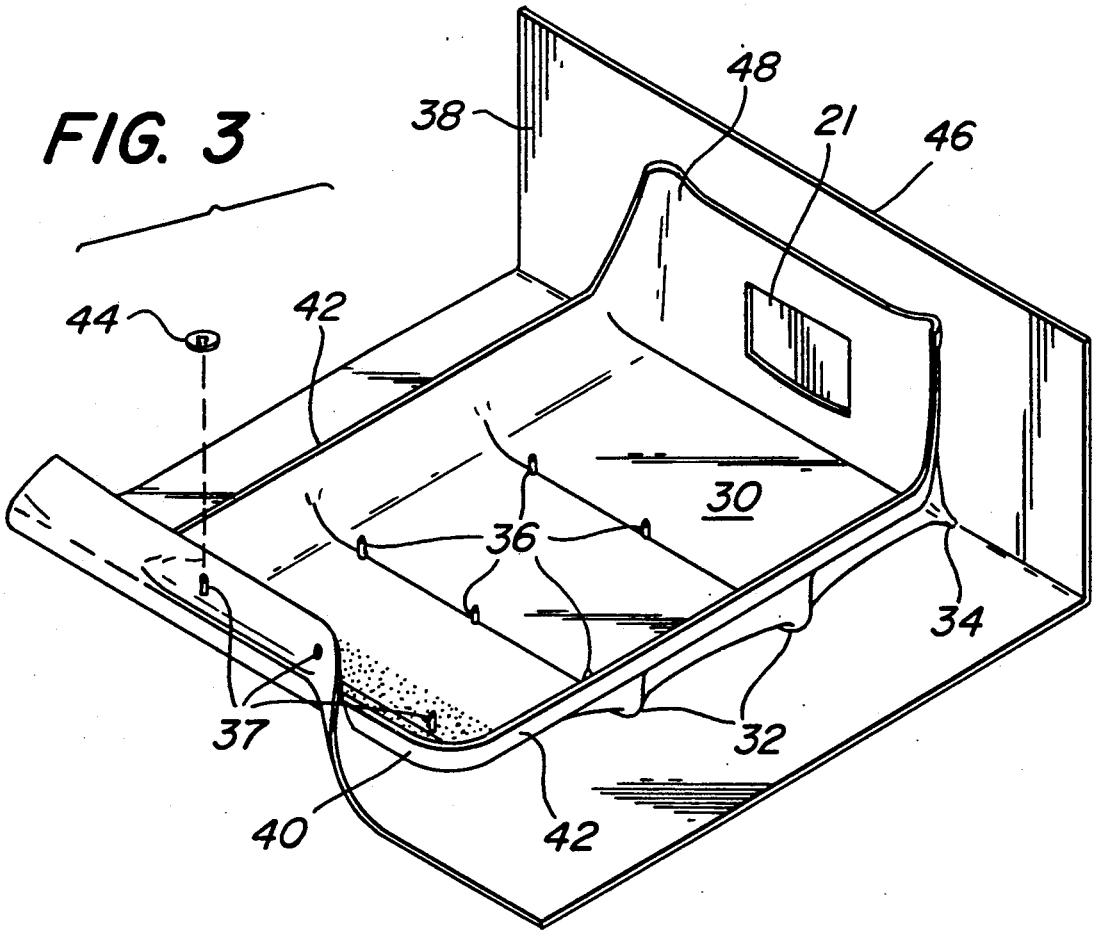
FIG. 3 is a top oblique view of the top frame and fabric cover in partial assembly.
Figure 4:
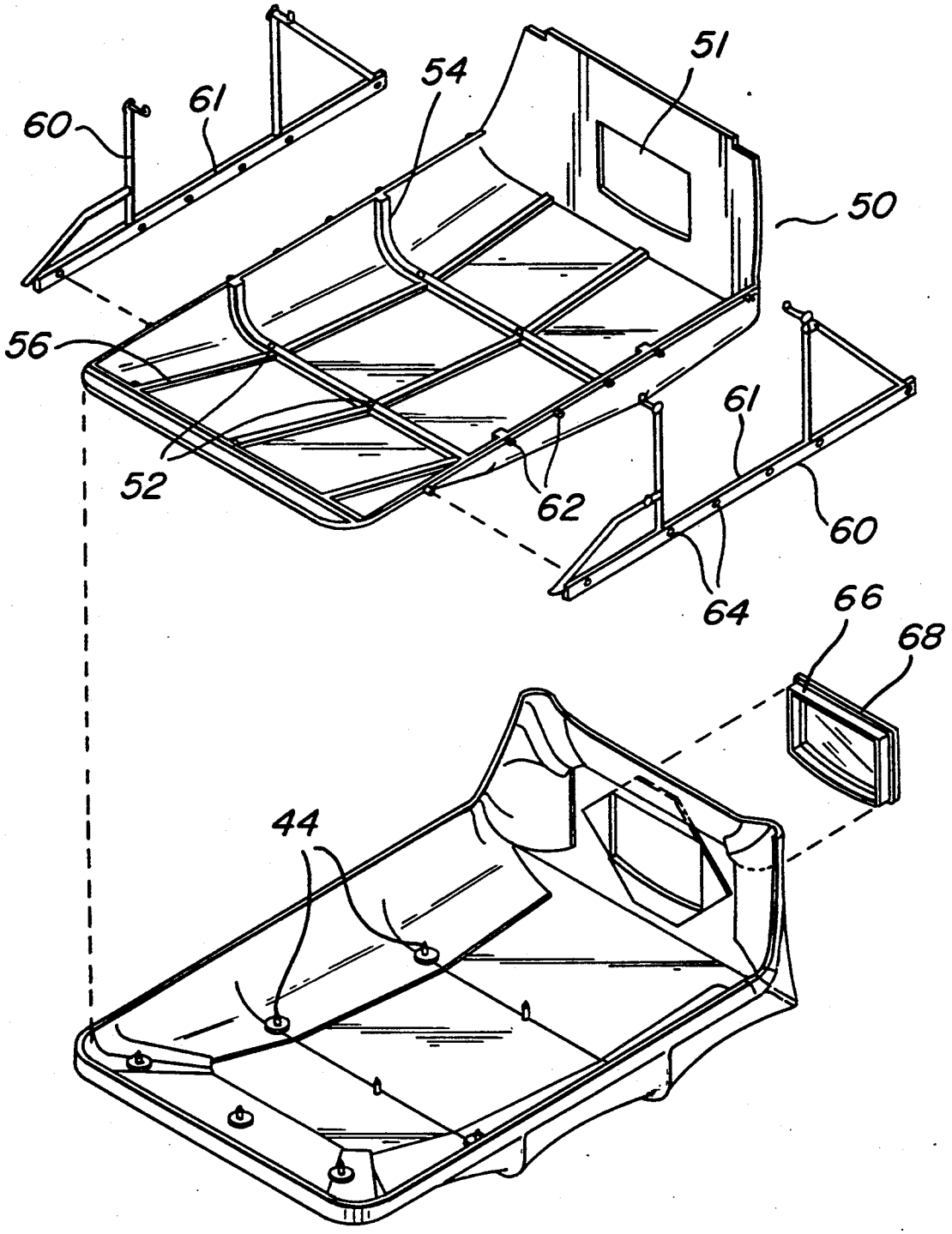
FIG. 4 is an inverted, exploded view of the roof of FIG. 2.

Instead, as shown in FIGS. 3 and 4, the present invention uses a top frame (30) which has front, back and lateral sides which duplicate the side contour of the roof, and which is spanned by a plurality of spaced transverse ribs (32) shaped to simulate the upper portion of the top bows (12,14), and a transverse rib (34) at the rear corner to simulate the back bow (16). The back side of the frame extends in a back panel to support the fabric of the back curtain, and a window opening (21) is provided in the appropriate location of the panel.

As shown on FIG. 3, the inner face of the frame, beneath each top rib (32), has three evenly spaced pegs (36), with the middle peg being essentially on the centerline of the frame. Another three pegs (37) are provided in matching alignment adjacent the front side (40) of the frame to create a nine-peg pattern. A die-cut piece of fabric (38) may be placed flat under the top face of the ribs and folded around the front side (40) of the frame, and clamped to one or more of the pegs (37) adjacent the front side by an internal-toothed washer (44) being pressed over the peg and fabric. The fabric is then stretched over the ribs from the front side toward the back panel (48) and folded around the lateral sides (42), and similarity clamped to the pegs adjacent the lateral sides by a toothed washer. The washers provide immediate anchoring points to pull against in stretching the fabric tautly over the ribs. The loose back end (46) of the fabric can be pulled up along the back panel (48), folded around the panel and glued to it with adhesive, since the tension on the fabric is held by the washer and peg clamps, as shown on FIG. 4.

A bottom plate (50) adapted to fit inside the top frame (30) has a shape generally matching the contour defined by the inside surface of the top frame, including a matching window opening (51), except for its lateral sides where space is left between frame and plate to accommodate support post inserts to be described hereafter. The bottom plate contains nine bores (52) arranged to match the pattern of the nine pegs (36,37) in the frame. The bores are shaped to receive the pegs in a closely conforming press-fit. To maintain the plate's structural strength and simultaneously enhance its simulation of realism, the bores are located in raised transverse belts (54) extending across the bottom face of the plate which simulate the sides and bottom of the bows, and in longitudinal (56) belts which simulate the reinforcing webs and stays sewn into the original cover. The height of pegs is such that the peg tips are inserted essentially flush with the surface of the belts, thus hiding the pegs and bores. Between the belts, the plate has a surface texture which simulates the visual appearance of the fabric.

The side support posts (24, 26) are simulated by two inserts (60) in which the posts are attached to a rail (61) which is connected by pins (62) and bores (64) to the plate (50) before the plate is placed into the top frame. The inserts locate the vertical posts at a lateral side of the frame beneath the transverse ribs (32) and belts (54), and appear to be a continuation of the ribs and belts to simulate the lower uncovered portions of the bows. The rear window is a snap-in insert (66) of clear plastic with a framed edge (68) to cover the fabric near the window opening.

Method of Assembly

Starting with the top frame and fabric, the fabric is die-cut into a sheet (38) having a size and shape that can be stretched over the transverse ribs, folded around the frame sides and clamped to the pegs. The sheet is spread on a flat surface, and the frame (30) is placed upside-down on the sheet such that the transverse ribs rest on the sheet as shown in FIG. 3.

Preferably, the front edge of the sheet is folded around the front side (40) of the frame, and the folded portion is laid over the first row (37) of three pegs adjacent the front side, and a toothed washer (44) is placed over at least the middle peg in the front row. The fabric can then be stretched across the bows in any order by pulling it taut, folding it under a side, placing the folded portion over an adjacent peg, and clamping it with a toothed washer. The two front corner pegs will have both front and side flaps of the fabric secured under the washer, as shown in FIG. 4. In the depicted Model-T, the fabric is preferably folded around the back panel (48) and adhesively tacked to the inside of the back panel above the window opening.

The roof support post inserts (60) are then attached to the bottom plate side pegs (62) by their bores (64), and the plate is placed inside the frame and receives the pegs (36,37) in a press-fit by pressing the pegs into the bores (52). Adhesive can be used for additional fixation on the side inserts and between the frame and plate. The fabric is slit at the window opening and the rear window is snapped into the opening. The roof assembly can then be mounted on the model automobile.

Industrial Applicability

The present invention is expected to be used in the crafting of high quality miniature and scaled model vehicles where authentic replication of the appearance and feel of the full-sized original is important to the collectors of such models.

The present invention may be embodied in other specific forms without departing from the spirit or essential attributes thereof and, accordingly, reference should be made to the appended claims, rather than to the foregoing specification, as indicating the scope of the invention.

I claim:

1. A fabric covered roof for model vehicles which simulates a vehicle roof of the type in which a fabric cover is attached to bows, comprising:

(a) an upper frame having front, back and lateral sides which is spanned on a top face thereof by a plurality of spaced transverse ribs extending between the lateral sides, wherein said ribs are shaped to simulate the upper portion of said bows;

(b) a plurality of pegs depending from a bottom face of said frame, said pegs being arranged in a pattern:

(c) a fabric cover stretched over said transverse ribs, said cover being folded around the frame sides and clamped to at least one of said pegs;

(d) a bottom plate adapted to fit inside said upper frame and having a shape generally matching the contour defined by the bottom face of the frame, and further having bores arranged in a matching pattern thereon adapted to receive said pegs in a closely conforming fit to hold said frame and plate together.

2. A roof as in claim 1, further comprising said bores being located in raised transverse belts extending across a bottom face of the bottom plate, said raised belts shaped and arranged to simulate the sides and bottom of said bows.

3. A roof as in claim 2, further comprising the bottom face of the plate having a textured surface between said raised belts which simulates the visual texture of the fabric cover.

4. A roof as in claim 1, further comprising one or more support posts connected between the plate and a lateral side of the frame beneath a transverse rib, wherein said support post simulates the lower portions of said bows.

5. A roof as in claim 3, further comprising one or more support posts connected between the plate and a lateral side of the frame beneath a transverse rib, wherein said support post simulates the lower portions of said bows.

6. A roof as in claim 1, further comprising said back side of the frame including a back panel having an opening in the shape of a desired window, and said bottom plate further including a back panel matching the contour defined by the back panel of the frame and having matching opening therein, and a window insert comprising an optically clear pane conforming to the dimensions of said openings and adapted to be press fit into the openings.

7. A roof as in claim 1, further comprising the fabric cover being clamped to said pegs by said cover being laid over a peg and a toothed washer pressed over the peg.

8. A roof as in claim 3, further comprising the fabric cover being clamped to said pegs by said cover being laid over a peg and a toothed washer pressed over the peg.

9. A roof as in claim 4, further comprising the fabric cover being clamped to said pegs by said cover being laid over a peg and a toothed washer pressed over the peg.

10. A method of assembling a fabric covered roof for model vehicles which simulates a vehicle roof of the type in which a fabric cover is attached to bows, comprising the steps of:

(a) obtaining a frame having front, back and lateral sides which is spanned by a plurality of spaced transverse ribs extending between the lateral sides and shaped to simulate the upper portion of said bows, and having a plurality of pegs arranged in a pattern depending from a bottom face of said transverse ribs toward an open center of the frame, (b) cutting a sheet of fabric to a size and shape wherein it can be stretched over said transverse ribs and folded around said sides and clamped to at least one of said pegs, (c) placing the frame on the sheet such that transverse ribs rest on the sheet, (d) folding an edge of said sheet around a first side of the frame and placing the folded portion over at least one of said pegs, (e) clamping said folded portion to said peg, (f) pulling said sheet taut across said transverse ribs and frame sides and folding the excess portions of the sheet around the frame sides, (g) securing said excess portions to the frame either by clamping them to said pegs or fastening them to a side of the frame by adhesive, (h) obtaining a bottom plate adapted to fit inside said frame and having a shape generally matching the contour defined by the frame, and further having bores arranged in a matching pattern thereon adapted to receive said pegs in a closely conforming fit to hold said frame and plate together, and (i) attaching said bottom plate to the frame by pressing the pegs into the bores.

* * * * *